US006662917B1

(12) United States Patent
Wolf et al.

(10) Patent No.: US 6,662,917 B1
(45) Date of Patent: Dec. 16, 2003

(54) 2 RAIL TO 3 RAIL CONVERSION APPARATUS FOR USE IN MODEL TRAINS

(75) Inventors: Mike Wolf, Highland, MD (US); Dave Krebiehl, St. Joseph, MI (US)

(73) Assignee: Mike's Train House, Inc., Columbia, MD (US)

( * ) Notice: Subject to any disclaimer, the term of this patent is extended or adjusted under 35 U.S.C. 154(b) by 0 days.

(21) Appl. No.: 10/217,143

(22) Filed: Aug. 13, 2002

(51) Int. Cl.[7] ..... B60L 5/00
(52) U.S. Cl. ..... 191/46
(58) Field of Search ..... 191/1 R, 45 R, 191/46, 49; 104/287, 288, DIG. 1; 105/1.5, 49

(56) References Cited

U.S. PATENT DOCUMENTS 4,267,906 A * 5/1981 Fischer ..... 191/49
4,286,698 A * 9/1981 Fischer ..... 191/49
4,665,833 A * 5/1987 Fleishman et al. ..... 104/301

* cited by examiner

*Primary Examiner*—S. Joseph Morano
*Assistant Examiner*—Robert J. McCarry, Jr.
(74) *Attorney, Agent, or Firm*—McDermott, Will & Emery

(57) ABSTRACT

A model train capable of operating on either a two rail system or a three rail system, the model train including: an electrical device having a first power terminal and a second power terminal; a first wheel assembly for engaging a first rail; a second wheel assembly for engaging a second rail; a pickup member for engaging a third rail; and a switch member coupled between the motor, the first wheel assembly, the second wheel assembly and the pickup member, the switch operable in a first state and a second state, wherein in the first state the switch couples the pickup member to the first power terminal, and couples the first wheel assembly and the second wheel assembly to the second power terminal, and in the second state the switch couples the first wheel assembly to the first power terminal and couples the second wheel assembly to the second power terminal.

20 Claims, 6 Drawing Sheets

2 RAIL TO 3 RAIL CONVERSION APPARATUS FOR USE IN MODEL TRAINS

FIELD OF THE INVENTION

The present invention relates to an apparatus that allows for model trains to be operated on either a track layout having 2 rails or a track layout having 3 rails, and more particularly, to an apparatus that readily allows the operator to configure the model train to operate in either a 2 rail configuration or a 3 rail configuration.

BACKGROUND OF THE INVENTION

The use of both 2 rail track layouts and 3 rail track layouts are well known in the model train industry. For example, when "O Gauge" model railroading systems were first introduced in approximately the 1940's, the systems employed a 3 rail track layout. In such 3 rail systems, the third rail, which is disposed in the center of the track between the two outside rails, functions to supply power to the locomotive. The locomotive is provided with a pickup roller, which extends downward from beneath the bottom of the locomotive and engages the third rail. The pickup roller functions to couple the power signal on the third rail to the motor of the locomotive. The two outside rails function as the ground source (or return path) for the motor of the locomotive, and are coupled to the motor of the locomotive via the left and right wheel assemblies of the locomotive. In such systems, the left and right wheel assemblies are electrically coupled together. Typically, the power signal provided on the third rail by a power supply is an AC signal in a range of 5 to 22 volts. The motor utilized by the locomotive can be either an AC or DC motor, with the latter requiring rectification of the power signal.

One long standing compliant about such 3 rail systems was that the "look" of the track was not realistic due to the inclusion of the middle rail (i.e., third rail). In response to these complaints, "HO-Gauge" systems, which utilized a 2 rail track, were introduced during the 1950's. The 2 rail system solved the problem of the "unrealistic" appearance of the 3 rail track systems. HO-Gauge systems utilized locomotives having only DC motors, which were powered by a DC power supply coupled to the tracks. The power supply was coupled to the motor of the locomotive via the wheels of the locomotive, with one track coupled to the positive terminal of the DC power supply, and the other track coupled to the negative terminal of the DC power supply. Of course, this power supply configuration mandated that the wheel structure on one side of the locomotive be electrically isolated from the wheel structure on the opposite side of the locomotive.

Shortly after the introduction of the 2 rail HO-Gauge systems, 2 rail O-Gauge systems were introduced. However, such 2 rail O-Gauge systems have never been widely accepted in the industry due to various problems associated with their use. For example, the use of AC power over the track rails, as opposed to DC power, greatly simplifies and enhances the operation of model train systems. More specifically, when utilizing AC power, the polarity of the current supplied to the track rails is not an issue. However, the polarity of the power signal applied to the tracks is an issue when utilizing DC power, because if the power supply leads coupled to the track rails are reversed, the locomotive will go in the opposite direction. Thus, powering the system utilizing an AC power supply makes wiring the system a far simpler task in comparison to powering the system utilizing a DC power supply. In addition, by employing an AC power signal on the rails, it is possible to utilize small amounts of DC power, which are sent over the rails, as a signaling method for the activation of various features of the system (e.g., blowing the locomotive's whistle, ringing bells, etc.). As a consequence of the foregoing problems with 2 rail O-Gauge systems, 3 rail O-Gauge systems still exist and are being utilized today.

As a result of the continuing existence of both 2 rail and 3 rail systems, model train enthusiasts often undertake the task of converting locomotives initially designed for use with 3 rail systems to ones that are capable of operating on 2 rail systems (and vice versa). However, such a conversion is extremely time consuming and requires both special tools and considerable mechanical skill. For example, when converting a model train designed to operate on a 3 rail system to one that operates on a 2 rail system, the conversion process requires the removal of the third rail pickup from the locomotive, as well as the modification of the wheel and axle design of the locomotive. While the removal of the third rail pickup is a fairly simple process, the modification of the wheel and axle design is not. This part of the conversion process requires that the locomotive be modified such that a first set of wheels located along the same side of the locomotive be insulated from a second set of wheels located on the opposite side of the locomotive. In addition, one of the sets of wheels must also be insulated from the chassis of the locomotive. Further, a set of wipers (i.e., contacts) must be installed so as to brush against the set of wheels insulated from the chassis (the wipers must also be insulated from the chassis). The wipers are connected to a wire harness and function to couple the power signal transmitted over one rail and through the insulated set of wheels to the motor or electronics inside the locomotive. A second wire harness is also required to couple the ground signal from the other rail through the non-insulated set of wheels to motor or electronics inside the locomotive.

As is evident from the foregoing description, converting a model train design to operate on a 3 rail configuration to one that operates on a 2 rail configuration is an extremely complex and time consuming process. Converting the model train in the opposite direction (i.e., 2 rail to 3 rail) is equally complex. Moreover, the process is not one that can be performed unless the operator has substantial knowledge about the design and construction of model trains, and a sophisticated set of tools. Clearly, the average train hobbyist does not have such knowledge, or the necessary tools to perform this process.

Accordingly, there exists a need for a model train conversion system that allows an operator to easily convert the model train from a 2 rail configuration to a 3 rail configuration (and vice versa), and that does not require the operator to have any knowledge regarding model train design, or require the operator to disassembly the locomotive in order to perform the conversion.

SUMMARY OF THE INVENTION

The present invention relates to a conversion system, which is incorporated, for example in the locomotive of the model train set, that allows the operator to easily and quickly configure the model train for either 2 rail operation or 3 rail operation.

More specifically, the present invention relates to a model train capable of operating on either a two rail system or a three rail system. The model train includes: an electrical device having a first power terminal and a second power terminal; a first wheel assembly for engaging a first rail; a second wheel assembly for engaging a second rail; a pickup member for engaging a third rail; and a switch member coupled between the motor, the first wheel assembly, the second wheel assembly and the pickup member, the switch operable in a first state and a second state, wherein in the first state the switch couples the pickup member to the first power terminal, and couples the first wheel assembly and the second wheel assembly to the second power terminal, and in the second state the switch couples the first wheel assembly to the first power terminal and couples the second wheel assembly to the second power terminal.

As described below, the 2 rail to 3 rail conversion system provides important advantages over prior art conversion techniques. For example, in accordance with the present invention, the operator can essentially configure the locomotive for either 2 rail or 3 rail operation simply by flipping a switch. As such, the present invention eliminates the need for performing a time consuming and complicated conversion process. Moreover, the present invention allows any operator, even one without any knowledge of model train designs, to readily perform the conversion.

Additional advantages of the present invention will become apparent to those skilled in the art from the following detailed description of exemplary embodiments of the present invention.

The invention itself, together with further objects and attendant advantages, will best be understood by reference to the following detailed description, taken in conjunction with the accompanying drawings.

DETAILED DESCRIPTION OF THE DRAWINGS

The following detailed description of the 2 rail to 3 rail conversion system of the present invention sets forth exemplary embodiments of the device. It is noted, however, that the present invention as claimed herein is not intended to be limited to the specific embodiments disclosed in the following discussion. Clearly other implementations of the novel 2 rail to 3 rail conversion system are possible.

Figure 1:
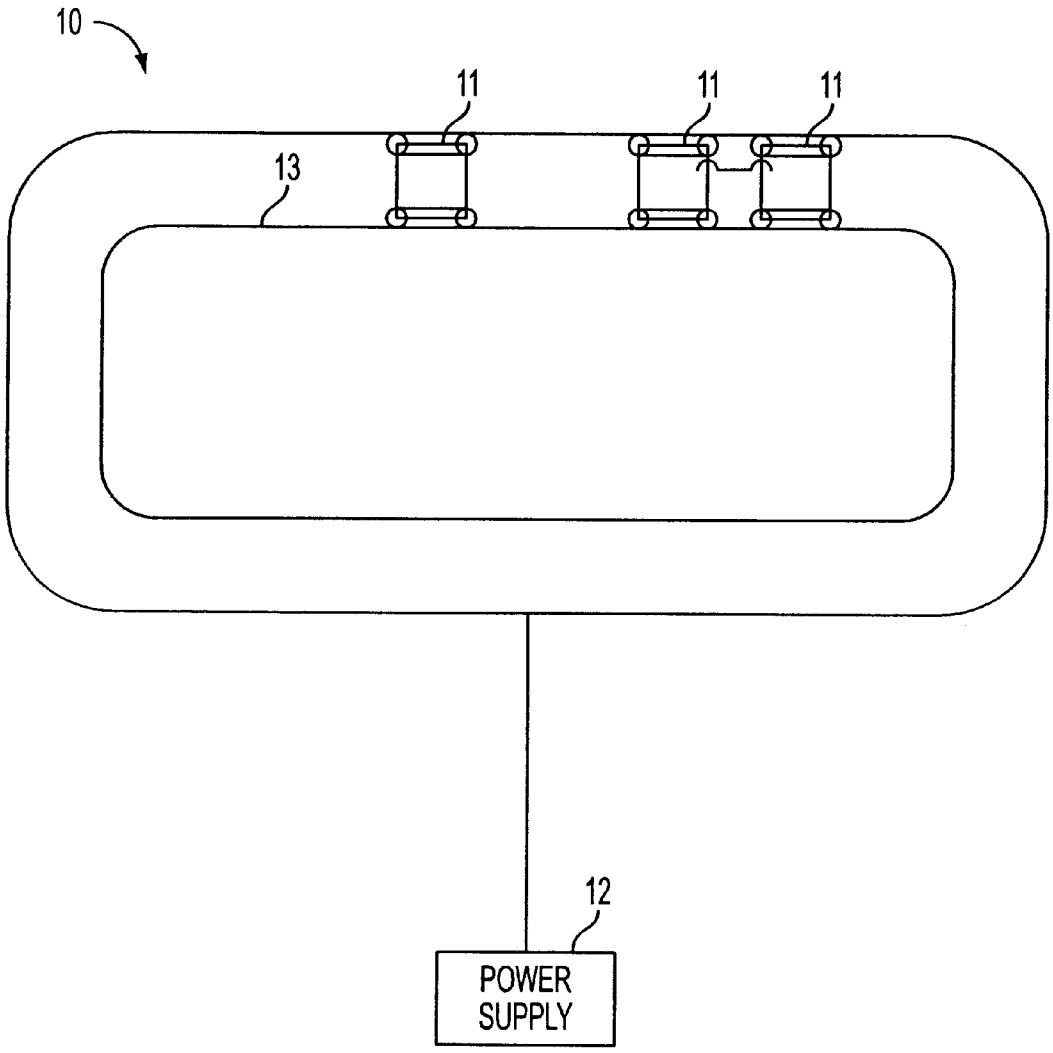
FIG. 1 illustrates a simplified exemplary embodiment of a 2 rail track layout.

FIG. 1 illustrates a simplified exemplary embodiment of a 2 rail track layout 10. As shown, the layout 10 includes a two rail track 13, trains 11 and a power supply 12, which is preferably an AC power supply. In such a 2 rail system, as mentioned above, an electrical device (e.g., motor) of the model train (e.g., locomotive) receives a power signal transmitted on one of the rails by the power supply 12 via the set of wheels in contact with the given rail. Again, it is noted that this set of wheels is electrically isolated from both the chassis of the model train and the set of wheels of the locomotive in contact with the opposite rail. The chassis and opposite set of wheels operate as a return path for the power signal supplied to the electrical device within the model train. The power signal is returned to the power supply 12 via the opposite rail.

In a 3 rail system, as noted above, the power signal is coupled from the power supply 12 to the third rail (not shown) and a pickup roller 95 provided on the bottom of the model train so as to contact the third rail (see, FIG. 4) couples the power signal to the electrical device within the model train. Further, both sets of wheels and the chassis are electrically coupled together, and act as the return path for the power signal. The power signal is returned to the power supply 12 via the two outside rails. The pickup roller 95 is electrically isolated from both sets of wheels and the model train chassis in the 3 rail configuration.

In accordance with the present invention, the internal wiring configuration of the model train is designed such that by toggling a switch provided on the model train between one of two states (i.e., 2 rail configuration state or 3 rail configuration state), the internal wiring of the model train is automatically configured to either the 2 rail wiring configuration or 3 rail wiring configuration noted above.

Figure 2A:
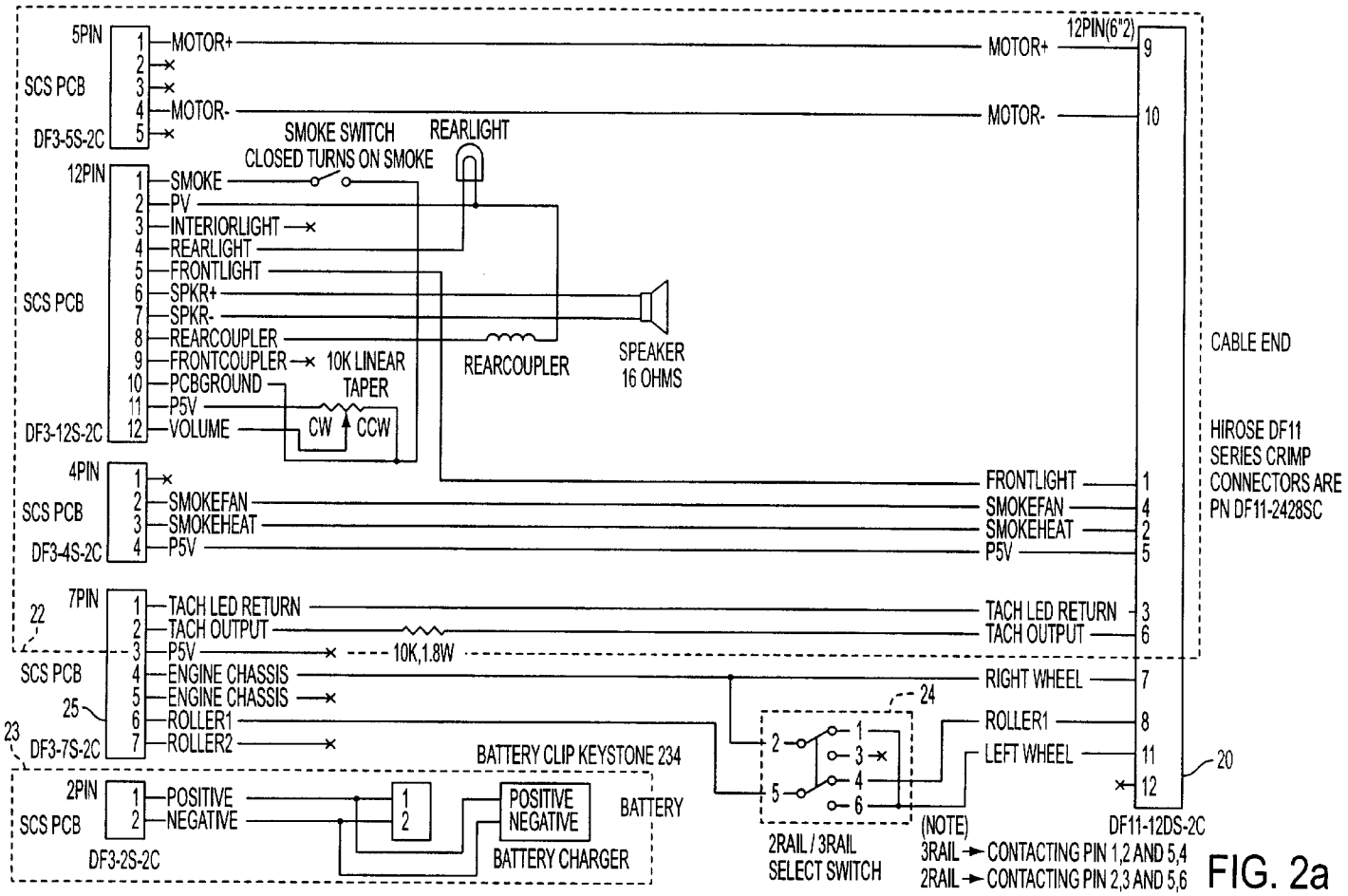
FIGS. 2A and 2B illustrate an exemplary schematic diagram of the internal wiring of a model train incorporating the 2 rail to 3 rail conversion system of the present invention.
Figure 2B:
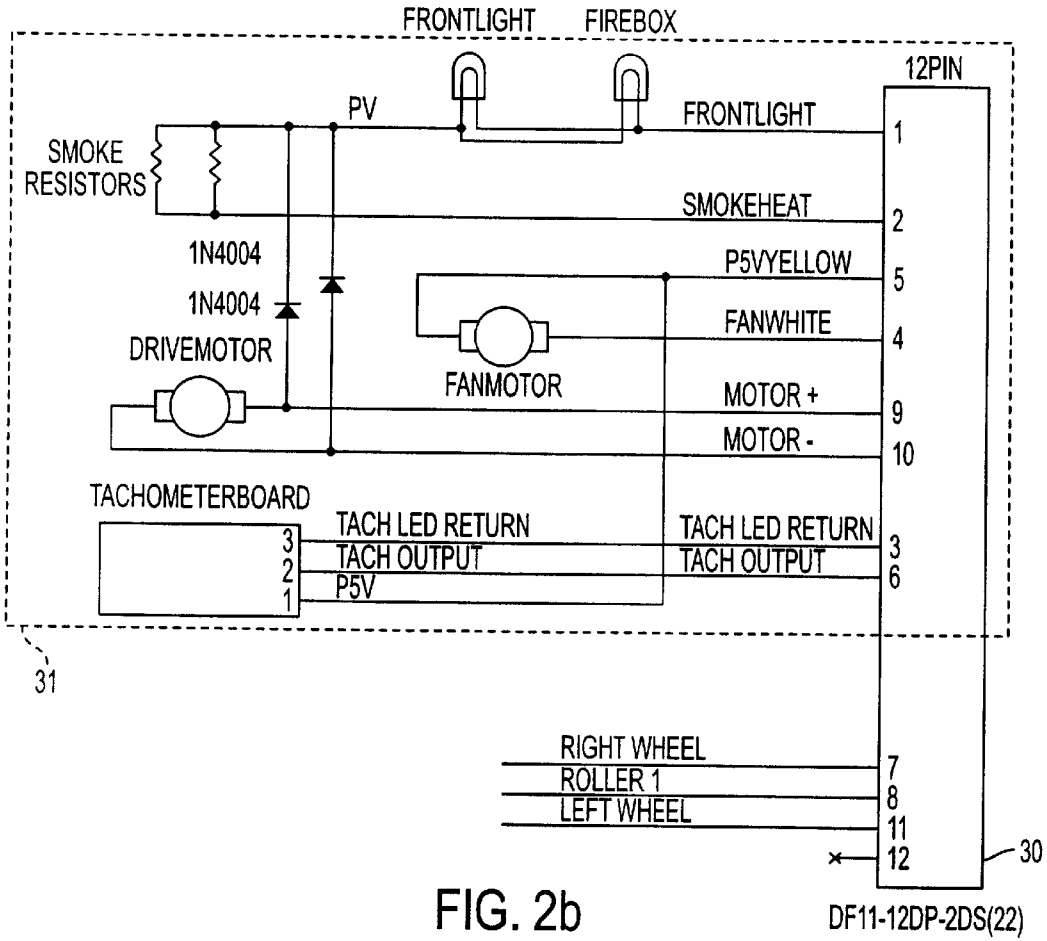

FIGS. 2*a* and 2*b* illustrate an exemplary schematic diagram of the internal wiring of a model train incorporating the 2 rail to 3 rail conversion system of the present invention. Referring to FIG. 2*a*, in the given embodiment, the wiring design includes a connector 20 having pins 7, 8 and 11 designated "right wheel", "roller 1" and "left wheel" respectively. Connector 20 is coupled to connector 30, which is illustrated in FIG. 2*b*. Connector 30 also has corresponding pins 7, 8 and 11 designated "right wheel", "roller 1" and "left wheel". The wires coupled to pins 7, 8 and 11 of connector 30 are hard wired to the respective component in the manner set forth below. It is noted that the components included in sections 22, 23 and 31 of the wiring schematic illustrated in FIGS. 2*a* and 2*b* are related to other components of the model train and do not form part of the 2 rail to 3 rail conversion system of the present invention.

Referring again to FIG. 2*a*, the wiring design further includes switch 24 and connector 25. Referring first to connector 25, the connector 25 includes pins 4 and 6, which are designated "engine chassis" and "roller 1", respectively. Pin 4 designated "engine chassis" is electrically coupled to the model train chassis and to the negative return of the electrical device of the model train. In the given embodiment, the chassis is always coupled to at least one set of wheels of the model train, and functions as part of the path of the power supply return line. Pin 6 designated "roller 1" is coupled to the positive power terminal of the electrical device of the model train, and functions to couple the power supply signal to the positive terminal of the electrical device of the model train. As explained below in more detail, pin 6 can be coupled to either an isolated set of wheels or the pickup roller disposed on the bottom of the model train.

Turning to switch 24, as will be described below, the state of switch 24 determines whether the model train is configured for operation in a 2 rail system or a 3 rail system. In the given embodiment, switch 24 is a two pole, two throw mechanical switch having pins 1–6. As shown, pin 2 is coupled to the chassis (pin 4 of connector 25) of the model train and to the right wheel assembly (pin 7 of connector 20) of the model train. It is noted that in accordance with the given embodiment, the right wheel assembly (pin 7 of connector 20) is always coupled to the chassis (pin 4 of connector 25). Pin 5 of switch 24 is coupled to the positive power terminal of the electrical device of the model train as it is coupled to the pin designated roller 1 (pin 6 of connector 25). Pin 1 and pin 6 of switch 24 are coupled to the left wheel assembly (pin 11 of connector 20), and pin 4 of switch 24 is coupled to the pickup roller (pin 8 of connector 20) disposed on the bottom of the model train. Pin 3 of switch 24 is coupled to ground.

The conversion between 2 rail and 3 rail configurations in now described in conjunction with the operation of switch 24. When switch 24 is controlled such that pin 2 contacts pin 1 and pin 5 contacts pin 4, the model train is configured for 3 rail operation. More specifically, in this state, pin 6 and pin 2 of switch 24 are coupled together which results in the left wheel assembly (pin 11 of connector 20), the right wheel assembly (pin 7 of connector 20) and the chassis (pin 4 of connector 25) all being electrically coupled to one another. In addition, the roller (pin 8 of connector 20) disposed on the bottom of the model train, which is positioned so as to make contact with the third rail, is electrically coupled to roller 1 (pin 6 of connector 25). Accordingly, power is supplied from the third rail to the roller and thereafter coupled to the positive power terminal of the electrical device within the model train. Both the left wheel assembly and the right wheel assembly are electrically coupled to one another and operate in conjunction with the chassis as a return path for the power supply 12. The left wheel assembly and right wheel assembly are electrically coupled to the power supply 12 via the outside rails of the track 13.

When switch 24 is toggled to its other position, the model train is configured for 2 rail operation. Specifically, in this state, within switch 24, pin 2 contacts pin 3, and pin 5 contacts pin 6. As such, the left wheel assembly (pin 1 of contact 20) is no longer electrically coupled to the right wheel assembly or the chassis as pin 2 of switch 24 is no longer in contact with pin 1 of switch 24. The left wheel assembly is electrically coupled to roller 1 (pin 6 of connector 25). Accordingly, power is supplied from the track rail in contact with the left wheel assembly to the roller and thereafter coupled to the positive terminal of the electrical device within the model train. The right wheel assembly and chassis, which are electrically isolated from the left wheel assembly, function as a return path for the power supply. The right wheel assembly is electrically coupled to the power supply via the track rail in contact with the right wheel assembly. It is noted that the pickup roller (pin 8 connector 20) is not coupled to anything when switch 24 is in the 2 rail configuration state.

As is clear from the foregoing description, in the design of the model train chassis, the right wheel assembly and the left wheel assembly is such that at least one of the wheel assemblies is electrically isolated from the other wheel assembly and the chassis. The wheel assemblies should only be electrically coupled to one another when switch 24 is toggled to the 3 rail mode of operation. In the foregoing embodiment, it is the left wheel assembly that can be isolated from the right wheel assembly and the chassis. However, it is also clear that this can be reversed. Further, it is noted that while the foregoing exemplary embodiment of the wiring configuration for implementing the 2 rail to 3 rail conversion system illustrates the use of various connectors referred to above, such connectors only serve to facilitate the wiring and manufacture of the model train. Clearly, such connectors are not required for practicing the present invention as the various contacts of switch 24 can be directly wired to the various components.

Figure 3C:
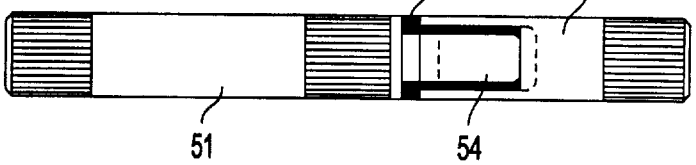
FIGS. 3*a*–3*c* illustrate an exemplary wheel and axle design for electrically isolating one of the wheel assemblies from the other wheel assembly and the model train chassis.
Figure 3A:
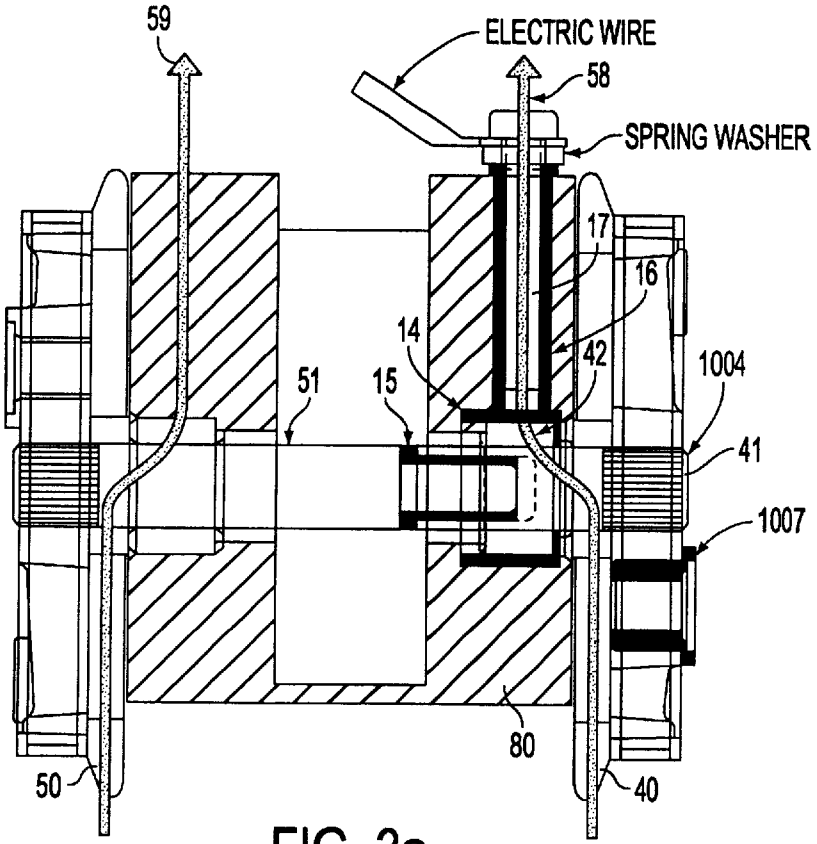
Figure 3B:
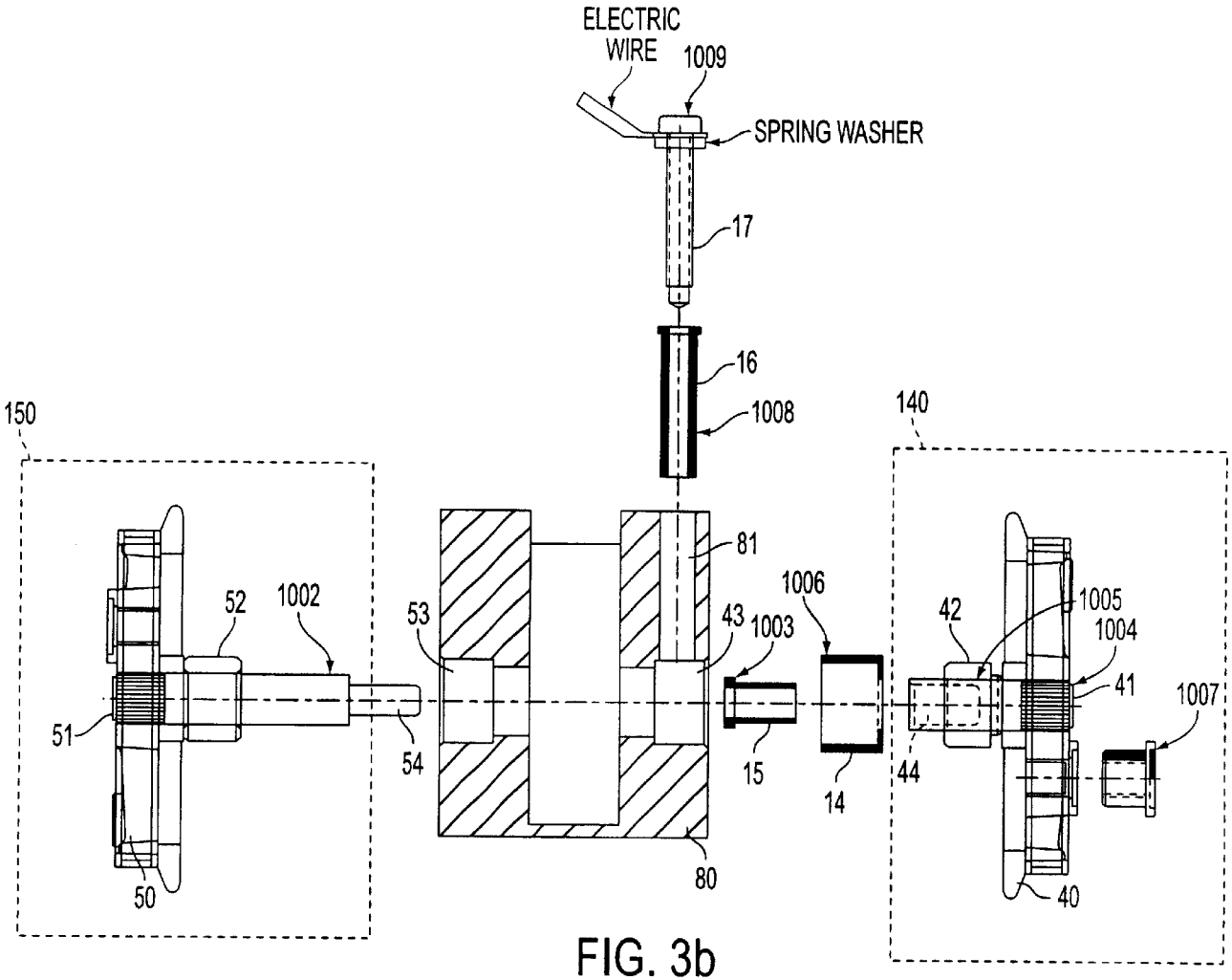

FIGS. 3*a*–3*c* illustrate an exemplary wheel and axle design for electrically isolating one of the wheel assemblies from the other wheel assembly and the model train chassis. As noted above, such isolation of one of the wheel assemblies is necessary for implementing the 2 rail to 3 rail conversion system. FIG. 3*a* illustrates the wheel and axle design in an assembled state, and FIG. 3*b* illustrates an exploded view of the design. Referring to the figures, the exemplary design includes a left wheel assembly 140 and a right wheel assembly 150. Both the left wheel assembly 140 and the right wheel assembly 150 has an axle member 41 and 51 securely fastened to a conductive wheel 40 and 50, respectively, such that the wheel 40 and 50 and corresponding axle member 41 and 51 rotate in unison with one another. Each axle member 41 and 51 has a conductive bearing member 42 and 52 disposed thereon, which abuts the inner surface of the corresponding wheel 40 and 50. The design further includes a housing member 80 (i.e., the model train engine chassis), which functions to receive the axle members 41 and 51.

More specifically, referring to the FIG. 3*b*, the housing member 80 includes openings 43 and 53, which function to receive the bearing members 42 and 52 of axle members 41 and 51, respectively. The bearing members 42 and 52 allow the axle members 41 and 51 to rotate relative to the housing member 80. In other words, the axle members rotate inside the bearing members 42 and 52 when the wheels 40 and 50 rotate. It is noted that the axle members 41 and 51 are mechanically coupled together in the assembled design. As shown in FIGS. 3*b* and 3*c*, axle member 51 has a plug member 54 which extends into an opening 44 formed in axle member 41 when the axle members 41 and 51 are properly positioned within the housing member 80.

In order to prevent axle member 41 and axle member 51 being electrically coupled to one another, insulators 14 and 15 are positioned on the bearing member 42 and the opening 44 of axle member 41 so as to isolate axle member 41 (and wheel 40) from axle member 51 and the housing member 80. It is noted that the housing member 80 includes another opening 81, which has an insulator 16 and a contact member 17 disposed therein. Insulator 16 is configured such that it isolates contact member 17 from the housing member 80, but allows contact member 17 to be in electrical contact with the bearing member 42. In the current design, the insulator 16 and the insulator 14 have aligned openings so as to allow the contact member 17 to physically contact the bearing member 42 when the device is assembled.

As a result of the foregoing structure, an electrical connection is formed between the wheel 40 and the contact member 17 so as to allow a power signal, which is transmitted over the track in contact with wheel 40, to be coupled to the contact member 17. Specifically, the conductive wheel 40 couples the power signal to the conductive axle member 41, which couples the power signal to the conductive bearing member 42, which couples the power signal to the contact member 17.

Similarly, an electrical connection is formed between the conductive wheel 50 and the housing member 80, which in the current embodiment corresponds to the model train chassis and which is formed of a conductive material. Specifically, the conductive wheel 50 is electrically coupled to the conductive axle member 51, which is electrically coupled to the conductive bearing member 52, which is electrically coupled to the housing member 80.

Referring again to the wiring schematics of FIGS. 2*a* and 2*b*, it is noted that in accordance with the current embodiment, pin 11 of connector 30 is coupled to contact 17, which is coupled to the left wheel assembly 140, and pin 7 of connector 30 is coupled to the housing member 80. As a result, it is possible to isolate the left wheel assembly 140 from both the right wheel assembly 150 and the chassis 80, while the right wheel assembly 150 is always electrically coupled to the chassis 80. Lines 58 and 59 illustrated in FIG. 3a represent the electrical path of the left wheel assembly 140 and the right wheel assembly 150, respectively.

Figure 4:
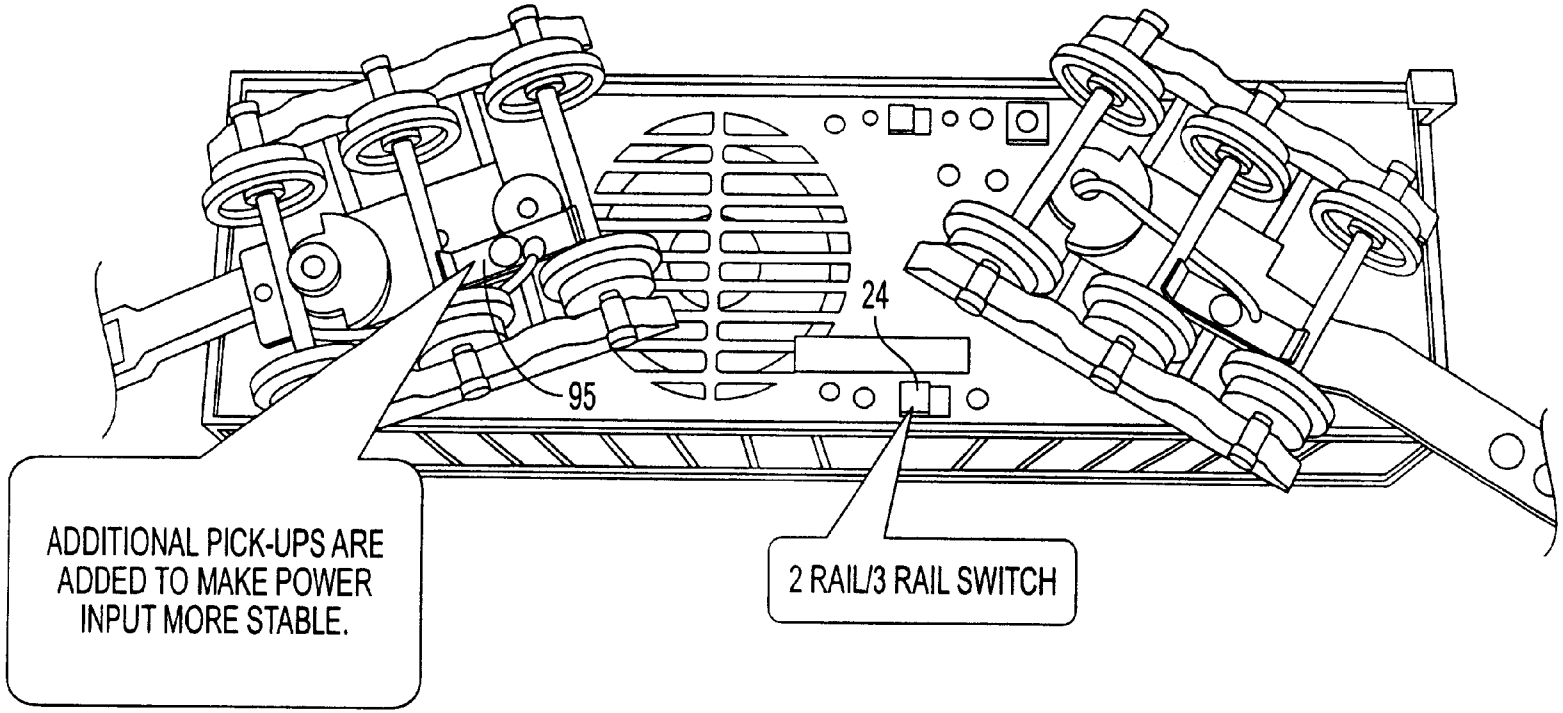
FIG. 4 is a bottom view of an exemplary model train which incorporates the 2 rail to 3 rail conversions system of the present invention.

FIG. 4 is a bottom view of an exemplary model train locomotive which incorporates the 2 rail to 3 rail conversion system of the present invention. As shown, access to switch 24, which in the current embodiment is a mechanical switch, is provided via the bottom surface of the locomotive. By simply toggling switch 24 into either the 2 rail configuration or the 3 rail configuration, the operator can control/select the desired mode of operation. Moreover, the operator can switch the configuration of the model train back and forth between the 2 rail and 3 rail configuration states as often as her/she likes simply by changing the position of switch 24.

FIG. 4 also illustrates an example of a pickup roller 95, which is utilized to contact the third "middle" rail when operating in the 3 rail configuration mode. As shown in this exemplary embodiment, the pickup roller 95 is disposed on the bottom surface of locomotive in a position so as to allow the pickup roller 95 to contact the middle rail of the track when the model train is properly placed on the track. The pickup roller 95 must be isolated from both the left wheel assembly and right wheel assembly. Referring to FIG. 2*b*, the pickup roller is electrically coupled (e.g., via a wire) to pin 8 of connector 30. As a result, when operating in the 3 rail configuration, the pickup roller 95 functions to couple the power signal present on the third rail to pin 8 of connector 30, which in turn couples the power signal to the positive terminal of the motor of the locomotive.

When operating in the 2 rail configuration, it is possible to remove the pickup roller 95 from the locomotive. Alternatively, pickup roller could be designed so as to be a spring loaded/retractable device, wherein in a first state the pickup roller would be locked in a position parallel and adjacent the bottom surface of the locomotive and would not contact the third rail, and in a second state (once the lock is released) the pickup roller would be forced by a spring member into contact with the middle rail of the track. Indeed, any type of connector that allows for repetitively connecting and disconnecting the pickup roller member 95 could be utilized.

As described above, the 2 rail to 3 rail conversion system of the present invention provides important advantages over prior art techniques for reconfiguring model trains to operate on the different rail systems. Most importantly, in accordance with the present invention, the operator can essentially configure the model train for either 2 rail or 3 rail operation simply by flipping a switch. As such, the present invention eliminates the need for performing a time consuming and complicated conversion process. Moreover, the present invention allows any operator, even one without any knowledge of model train design, to readily perform the conversion.

In addition, as the number of 3 rail layouts owned by hobby train enthusiasts significantly exceeds the number of 2 rail layouts, prior to the present invention, hobbyists were reluctant to purchase 2 rail systems or locomotives capable of operation on 2 rail systems because there was no resale value associated with two rail systems due to the small market share thereof (e.g., a locomotive designed for a 2 rail system could not operate on a 3 rail system without performing the extensive conversion process discussed above). However, the present invention eliminates this issue by allowing locomotives to be easily and quickly converted between 2 and 3 rail operation. As a result of the present invention, there is no longer any need to buy a locomotive of a given layout (i.e., 2 or 3 rail).

It is further noted that numerous variations are possible to the exemplary embodiment disclosed above. For example, while switch 24 was illustrated as a mechanical relay manually controlled by an operator, it is also possible to implement switch 24 as an electronic switch device, which is controllable, for example, by a remote control device, or via a microcontroller. Indeed, any switching device capable of performing the function of switch 24 as detailed above can be utilized.

In another variation the model train chassis does not comprise a conductive material, and an additional contact member such as the one utilized to contact the bearing member 42 is utilized to contact bearing member 52.

In yet another variation, the connector for allowing the connection and disconnection of the pickup roller from the model train includes a contact switch which indicates whether or not the pickup roller is coupled to the model train (i.e., when the contact switch is in a closed state the pickup roller is coupled to the model train, and when the contact switch is in an open state the pickup roller is removed). Such a switch can be utilized in connection with a microcontroller contained in the model train to automatically configure switch 24 (which in this embodiment would be an electrically controllable switch) to the proper state based on the presence or absence of the roller pickup.

Of course, it should be understood that a wide range of other changes and modifications can be made to the preferred embodiment described above. It is therefore intended that the foregoing detailed description be regarded as illustrative rather than limiting and that it be understood that it is the following claims including all equivalents, which are intended to define the scope of the invention.

What is claimed is:

1. A model train capable of operating on either a two rail system or a three rail system, said model train comprising:

an electrical device having a first power terminal and a second power terminal;

a first wheel assembly for engaging a first rail;

a second wheel assembly for engaging a second rail;

a pickup member for engaging a third rail; and a switch member coupled between said electrical device, said first wheel assembly, said second wheel assembly and said pickup member, said switch operable in a first state and a second state, wherein in said first state said switch couples said pickup member to said first power terminal, and couples said first wheel assembly and said second wheel assembly to said second power terminal, and in said second state said switch couples said first wheel assembly to said first power terminal and couples said second wheel assembly to said second power terminal.

2. The model train according to claim 1, wherein said electrical device comprises a motor.

3. The model train according to claim 1, wherein said switch is a mechanical switch.

4. The model train according to claim 3, wherein said switch comprises a control lever accessible to an operator so as to allow the operator to place said switch in either said first state or said second state.

5. The model train according to claim 1, wherein when said switch is in said second state said pickup roller is disconnected from said first power terminal and said second power terminal.

6. The model train according to claim 1, wherein when said switch is in said first state a positive power signal transmitted over said third rail is coupled to said first power terminal via said pickup member, and a negative power signal is transmitted to said first rail via said first wheel assembly and to said second rail via said second wheel assembly.

7. The model train according to claim 6, wherein when said switch is in said second state, said first wheel assembly and said second wheel assembly are electrically coupled to one another.

8. The model train according to claim 1, wherein when said switch is in said second state a positive power signal transmitted over said first rail is coupled to said first power terminal via said first wheel assembly, and a negative power signal is transmitted to said second rail via said second wheel assembly.

9. The model train according to claim 8, wherein when said switch is in said first state, said first wheel assembly and said second wheel assembly are electrically isolated from one another.

10. The model train according to claim 1, wherein said first power terminal receives a positive power signal, and said second power terminal provides a return signal path for said positive power signal.

11. A model train system comprising:

a power supply;

a track having at least two rails, said power supply being coupled to said track;

a model train configured to operate on said track, said model train comprising:

an electrical device having a first power terminal and a second power terminal;

a first wheel assembly for engaging a first rail;

a second wheel assembly for engaging a second rail;

a pickup member for engaging a third rail; and a switch member coupled between said motor, said first wheel assembly, said second wheel assembly and said pickup member, said switch operable in a first state and a second state, wherein in said first state said switch couples said pickup member to said first power terminal, and couples said first wheel assembly and said second wheel assembly to said second power terminal, and in said second state said switch couples said first wheel assembly to said first power terminal and couples said second wheel assembly to said second power terminal.

12. The model train system according to claim 11, wherein said electrical device comprises a motor.

13. The model train system according to claim 11, wherein said switch is a mechanical switch.

14. The model train system according to claim 13, wherein said switch comprises a control lever accessible to an operator so as to allow the operator to place said switch in either said first state or said second state.

15. The model train system according to claim 11, wherein when said switch is in said second state said pickup roller is disconnected from said first power terminal and said second power terminal.

16. The model train system according to claim 11, wherein when said switch is in said first state a positive power signal transmitted over said third rail is coupled to said first power terminal via said pickup member, and a negative power signal is transmitted to said first rail via said first wheel assembly and to said second rail via said second wheel assembly.

17. The model train system according to claim 16, wherein when said switch is in said second state, said first wheel assembly and said second wheel assembly are electrically coupled to one another.

18. The model train system according to claim 11, wherein when said switch is in said second state a positive power signal transmitted over said first rail is coupled to said first power terminal via said first wheel assembly, and a negative power signal is transmitted to said second rail via said second wheel assembly.

19. The model train system according to claim 18, wherein when said switch is in said first state, said first wheel assembly and said second wheel assembly are electrically isolated from one another.

20. The model train system according to claim 11, wherein said first power terminal receives a positive power signal, and said second power terminal provides a return signal path for said positive power signal.

* * * * *